United States Patent [19]

Sone

[11] Patent Number: 4,848,945

[45] Date of Patent: Jul. 18, 1989

[54] PRINTER HAVING ARRANGEMENT FOR FACILITATING PAPER CHANGING

[75] Inventor: Masakazu Sone, Kanagawa, Japan

[73] Assignee: Sony Corporation, Tokyo, Japan

[21] Appl. No.: 63,021

[22] Filed: Jun. 17, 1987

[30] Foreign Application Priority Data

Jun. 20, 1986 [JP] Japan ..... 61-144469

[51] Int. Cl.[4] ..... B41J 11/02

[52] U.S. Cl. ..... 400/649; 400/120; 400/613; 400/692; 400/660.2; 346/145

[58] Field of Search ..... 400/120, 611, 613, 613.4, 400/356, 659, 660, 660.2, 690, 691, 692, 690.4, 693, 693.1, 649, 648, 650; 346/76 PH, 136, 145; 312/319

[56] References Cited

U.S. PATENT DOCUMENTS

| | | | |
|---|---|---|---|
| 1,360,422 | 11/1920 | Lyon | 312/319 |
| 1,699,710 | 1/1929 | Pearlman | 312/319 |
| 3,266,048 | 8/1966 | Schweitzer | 346/145 |
| 3,270,350 | 8/1966 | Brandt et al. | 346/145 |
| 3,349,702 | 10/1967 | Nesin et al. | 101/DIG. 13 |
| 4,053,899 | 10/1977 | Strange | 346/145 |
| 4,119,974 | 10/1978 | Ondis et al. | 346/76 PH |
| 4,396,926 | 8/1983 | Manning et al. | 346/145 |
| 4,641,151 | 2/1987 | Kato et al. | 400/120 |

FOREIGN PATENT DOCUMENTS

| | | | |
|---|---|---|---|
| 30880 | 3/1981 | Japan | 400/120 |
| 133085 | 7/1984 | Japan | 400/613 |

OTHER PUBLICATIONS

W. D. Freeman, "Power Driven Hide-A-Way, Acoustic Hood", *IBM Technical Disclosure Bulletin;* vol. 20, No. 12, pp. 5229-5230; May 1978.

*Primary Examiner*—David A. Wiecking
*Attorney, Agent, or Firm*—Ronald P. Kananen

[57] ABSTRACT

A printer comprises a stationary chassis and a movable chassis mounted on the stationary chassis. A platen is mounted on the movable chassis at the front portion thereof. On the other hand, a printer head is mounted on the stationary chassis at the front portion thereof. The printer head opposes the platen when the movable chassis is placed in operating position. The printer head is associatred with an actuator which moves the printer head toward and away from the platen. The actuator normally holds the printer head away from the platen and is responsivel to rotation of the platen to bias the printer head to resiliently contact the platen.

28 Claims, 7 Drawing Sheets

PRINTER HAVING ARRANGEMENT FOR FACILITATING PAPER CHANGING

BACKGROUND OF THE INVENTION

1. Field of the Invention

The present invention relates generally to a printer, such as thermal printer, an ink jet printer and so forth. More specifically, the invention relates to a printer with a paper supply unit by which it is easy to set the paper in the printer.

2. Description of the Background Art

In recent years, there have been proposed a variety of printers, such as thermal printers, wire-dot printers, ink-jet printers and so forth. Some of the printers employ rolled paper as a printing medium. In conventional printers, a top lid of a casing is arranged so that it can be opened for setting or checking the quantity of a roll of paper. When the quantity of the paper remaining on the roll becomes small, the top lid is opened, the roll of the paper is taken out, and a new roll of paper is set therein. Inspection and maintenance of the printing zone and so forth is also carried out with the top lid open. In such printers, articles must not be placed on the printer and the space on and immediately above the printer should be always empty and vacant. Therefore, this type of printer is not preferable from the viewpoint of the effective utilization of space. Furthermore, the printer cannot be inserted into a unit such as a rack having a narrow horizontal space. When a structure is adopted in which the paper is set in the printer from above, in operation panel or the like is usually arranged on the upper side of a casing, and in this case, the printer must be placed at a low position, for example, on a desk, so that the operation panel can be easily seen. In the reason set forth above, the position of the conventional printer has been strictly limited.

Another type of the conventional printer has been disclosed in the Japanese Utility Model First (unexamined) Publication (Jikkai) Showa No. 61-84935. In the printer construction set out in the above-identified reference, a printer head and a platen are mounted on a printer chassis in a fixed relationship to each other. A space for receiving a roll of paper, such as heat-sensitive recording paper (hereafter referred to as "thermal paper") or so forth, is defined beneath the platen. The space for receiving the roll of the paper will be hereafter referred to as "roll space". When setting the roll of paper in the printer, the roll of paper is, at first, set in the roll space. Thereafter, a manually operable release lever is operated to release the printer head from the platen to form a gap to receive the paper unwinded from the roll. Then, the release lever is again operated to return the printer head toward the platen. By this, the paper is gripped between the printer head and the plane. In this structure, the paper setting operation has been troublesome work. In addition, such conventional printers arrange the printer head, platen and the roll space in vertical alignment, and the thickness of the printer casing has been necessarily large.

For providing a more compact printer which also facilitates easy set of roll of paper, the U.S. Pat. No. 4,641,980 discloses a printer including a casing having a front face, a printing unit, and a control circuit. The printing unit includes a printing medium attaching portion and a printer head portion attached to the printing medium attaching portion. The printing unit is supported in the casing by a moving mechanism so that the printing unit can be freely drawn out forward from the front face of the casing. The moving mechanism also automatically positions the printer head in an open position with respect to the printing medium attaching portion when the printing unit is drawn out from the casing. In the disclosed construction, a draw-out frame is provided in the moving mechanism for easily replacing the roll of paper when the draw out frame is in a position drawn out through the front face. After setting the roll of paper in the roll space defined in the draw-out frame, the frame is moved back into the printer casing. At the fully drawn-in position of the frame, the printer head is placed in contact with the platen with a predetermined biasing force. This means, as long as the frame is set in the printer casing, the printer head is always kept in contact with the platen. Such arrangement tends to cause damaging of the printer head by exerting vibration during transportation or so forth. As well, maintaining the printer head and the platen in contacting condition, secular change, e.g. wearing, deformation and so forth, occurs on the platen to substantially shorten the life of the platen. In addition, by constantly exerting the biasing force, a biasing device may be subject variation or change in its biasing force thereby varying printing performance. In addition, it is the usual practice in such type of printer to insert a spacer between the printer head and the platen to forcibly release the printer head from the platen during transportation. This requires a user's attention to remove the spacer before use. However, since the spacer is held inside of the casing, the user tends to face a difficulty in finding the spacer and removing the same.

In addition, the conventional printers as disclosed in the aforementioned U.S. Pat. No. 4,641,980 drive the drawn-out frame by means of an electric motor. This requires electric power in replacing the rolled paper. This may cause inconvenience if there is need for replacement of the rolled paper without electric driving power for the motor.

SUMMARY OF THE INVENTION

The principal object of the present invention is to provide a printer by which it is easy to set a roll of paper and which is compact in size.

Another object of the invention is to provide a printer which requires less height in facilitating a change of paper.

A further object of the invention is to provide a printer which will avoid damaging a printer head and a platen without requiring a spacer for holding the printer head away from the platen.

A still further object of the invention is to provide a printer which allows replacement of a roll of paper without requiring electric power.

In order to accomplish the aforementioned and other objects, a printer, according to the present invention, comprises a stationary chassis and a movable chassis mounted on the stationary chassis. A platen is mounted on the movable chassis at the front portion. On the other hand, a printer head is mounted on the stationary chassis at the front portion thereof. The printer head opposes the platen when the movable chassis is placed in an operating position. The printer head is associated with an actuator which moves the printer head toward and away from the platen. The actuator normally holds the printer head away from the platen and is responsive to rotation of the platen to bias the printer head to resiliently contact the platen.

According to one aspect of the invention, a printer comprises a stationary chassis, a movable chassis slidably mounted on the stationary chassis, a platen mounted at a front portion of the movable chassis, a printing head mounted at a front portion of the stationary chassis so as to oppose to the platen when the movable chassis is slid into an operative position, printing head lifting links mounted on the stationary chassis for lifting up the printing head away from a surface of the platen when the movable chassis is pushed into the operative position, and lifting links releasing means coupled to the platen and the printing head lifting links for releasing the printing head so as to be pressed against the platen by rotation of the platen.

According to another aspect of the invention, a printer comprises a stationary chassis, a movable chassis slidably mounted on the stationary chassis, a platen and a printing medium-attaching portion mounted on the movable chassis, a printing head mounted on the stationary chassis, a platen positioning means mounted on each side of the stationary chassis for fixing ends of a platen shaft when the movable chassis is inserted to the stationary chassis, and a platen guide mounted on the movable chassis at a level corresponding to the platen positioning means to make it possible to insert and withdraw the movable chassis relative to the stationary chassis.

According to a further aspect of the invention, a printer comprises a platen, a printing head pressed to the platen by a spring, a printing head holding means for holding the printing head in an operative position in contact with the platen and in an inoperative position spaced from the platen, a printing head lifting links releasing the printing head from the platen opposed the spring power by motion of the printing head holding means, a lifting links releasing means releasing a separatness the platen and the printing head, and a driving structure driven the lifting links releasing means by ordinary rotation of the platen.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment, but are for explanation and understanding only.

In the drawings.

DESCRIPTION OF THE PREFERRED EMBODIMENT

Figure 1:
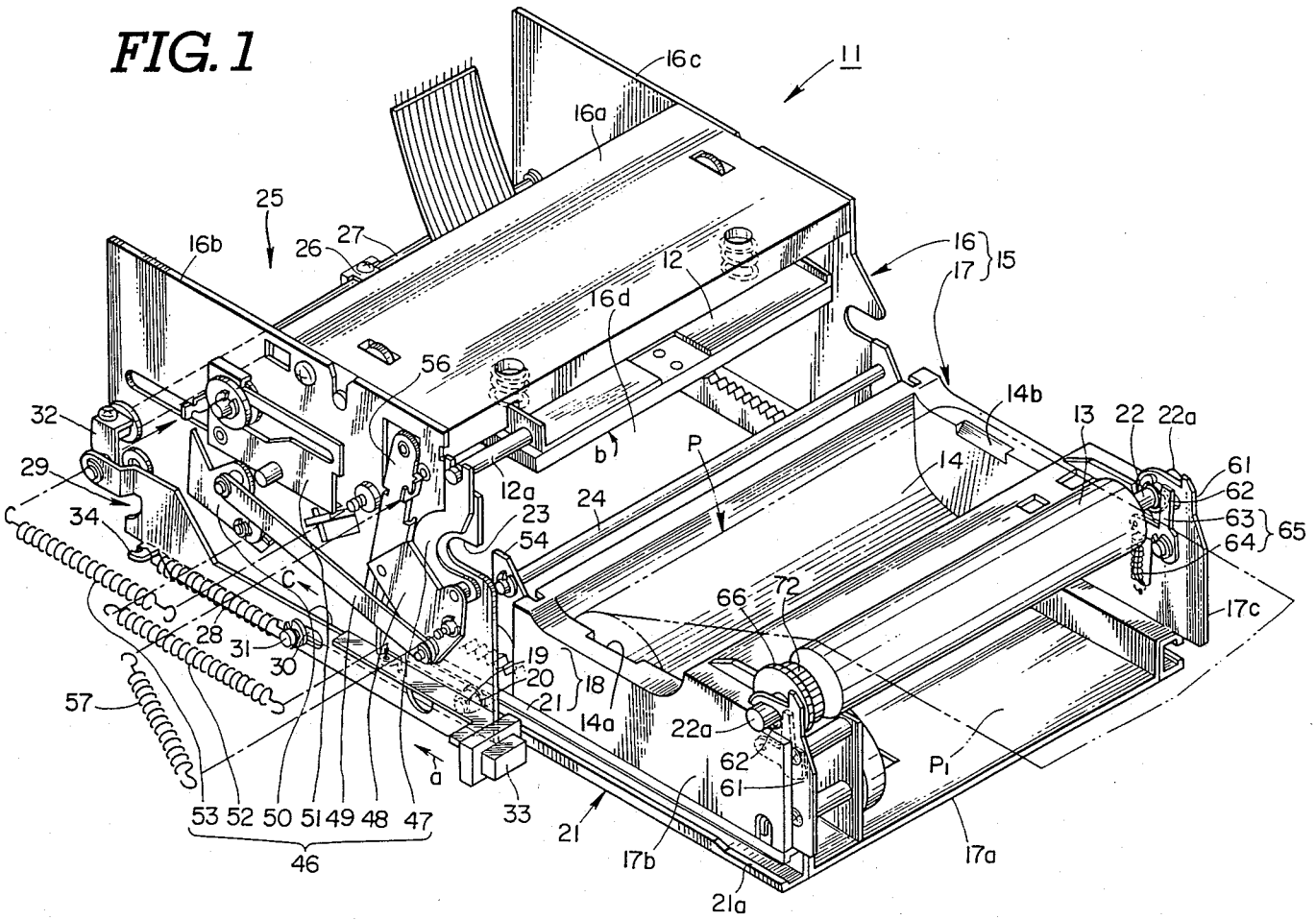
FIG. 1 is a perspective view of the preferred embodiment of a printer according to the invention, in which a cover of a printer casing is omitted for explanation purposes and in order to show the internal construction.

Referring now to the drawings, particularly to FIGS. 1 to 4, the preferred embodiment of a printer 11, according to the present invention, comprises a chassis 15 on which are mounted a printer head 12 and a platen 13. The chassis 15 also defines a space 14 for receiving a rolled roll of paper. The chassis 15 comprises a stationary chassis 16 and a movable chassis 17. The movable chassis 17 is associated with a sliding mechanism 18 so as to be reciprocally movable relative to the stationary chassis 16.

The stationary chassis 16 is formed into a cross-sectionally rectangular thin box-shaped configuration with upper and lower horizontal plates **16*a* and 16*d* and side walls 16*b* and 16*c* extending vertically from the lateral ends of the upper and lower plates 16*a* and 16*d*. The front and rear ends of the stationary chassis 16 are open so that the movable chassis 17 may move along the longitudinal axis by means of the sliding mechanism 18. The printer head 12 is mounted at the front end of the upper plate 16*a***.

The movable chassis 17 has a bottom plate **17*a* and side walls 17*b* and 17*c* vertically extending from both lateral edges of the bottom plate. The movable chassis 17 of a size to be received within the internal space of the stationary chassis 16 through the front end opening of the latter. The platen 13 is mounted on the movable chassis 17. The platen 13 is positioned at the upper front end of the movable chassis 17. The movable chassis 17 also defines the rolled paper storage space 14. So as to support the rolled paper rotatably within the rolled paper storage space 14, indentations 14*a* and 14*b* extend into the inner surface of the side walls 17*b* and 17*c*. The indentations 14*a* and 14*b* are so designed as to engage with a cylindrical core of the rolled paper P for rotatably supporting the latter within the rolled paper storage space 14**.

Figure 3:
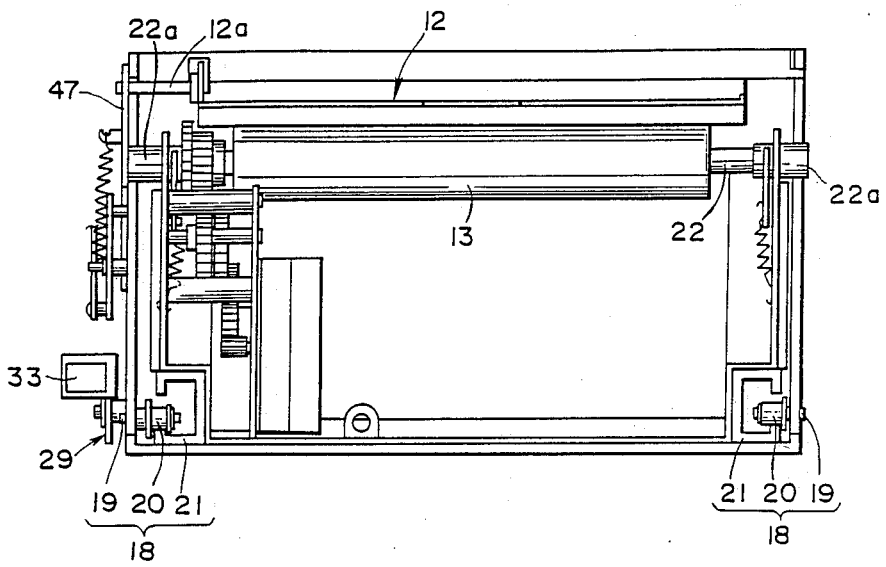
FIG. 3 is a front elevation of the printer of FIG. 1.

The sliding mechanism 18 comprises guide rollers 20 rotatably supported by roller shafts 19 extending from the lower front and rear ends of the side walls **16*b* and 16*c* of the stationary chassis, and generally C-shaped sliding rails 21 mounted along the lower side edges of the movable chassis 17, as best shown in FIG. 3. The sliding rails 21 engage with the guide rollers 20 for allowing the movable chassis to move along the longitudinal axis of the printer 11. With this sliding mechanism 18, the movable chassis 17 is movable between a set position, in which it is received within the stationary chassis with the platen 13 and the rolled paper storage space 14 located at predetermined positional relationships with the components of the stationary chassis for performing a printing operation, and an extracted position, in which it is fully moved out of the stationary chassis 16 so as to expose the rolled paper storage space 14** out of the stationary chassis for allowing a changes of rolled paper P.

As seen from FIGS. 1 and 3, the platen 13 has a rotary shaft 22 extending from both ends thereof. Bearing bushings **22*a* are mounted on both lateral ends of the rotary shaft 22 and are rotatably engaged with an elongated opening 62 formed on the upper front edge of the side walls 17*b* and 17*c* of the movable chassis 17. The lateral ends of the bearing bushings 22*a* further extend laterally from the side walls 17*b* and 17*c* so that they may engage with essentially U-shaped positioning cut outs 23 formed on the front edges of the side walls 16*b*** and 16c of the stationary chassis 16, when the movable chassis 17 is moved to the aforementioned set position. By engaging the bearing bushings 22a with the cut outs 23, the positioning of the platen relative to the printer head at the predetermined relationship to each other can be achieved.

The movable chassis 17 also has a stopper shaft 24 extending along the upper rear edge thereof. The stopper shaft 24 is engageable with a locking mechanism 25 at the set position of the movable chassis 17 for locking the latter at the set position inside chassis 16. As best seen from FIG. 2, the locking mechanism 25 comprises a locking hook 26 mounted on a rotary shaft 27. The rotary shaft 27 is normally biased in locking direction (counterclockwise direction in a FIG. 2) by means of a biasing coil spring 28 which is connected to the rotary shaft 27 via a link lever 32 and a lock release lever 29. The locking hook 26 has a tapered guide edge 26a at the front edge. The stopper shaft 24 of the movable chassis 17, first contacts the guide edge 26a while the movable chassis 17 moves from the extracted position to the set position. By the force exerted through the stopper shaft 24, the locking hook 26 and the rotary shaft 27 are rotated in an unlocking direction opposite to the locking direction against the biasing force of the biasing coil spring 28 to allow the stopper shaft 24 to pass over the locking hook 26. After the stopper shaft 24 passes over the locking hook 26, the locking hook is rotated with the rotary shaft 27 in the locking direction to establish locking for the movable chassis 17 at the set position.

Figure 2:
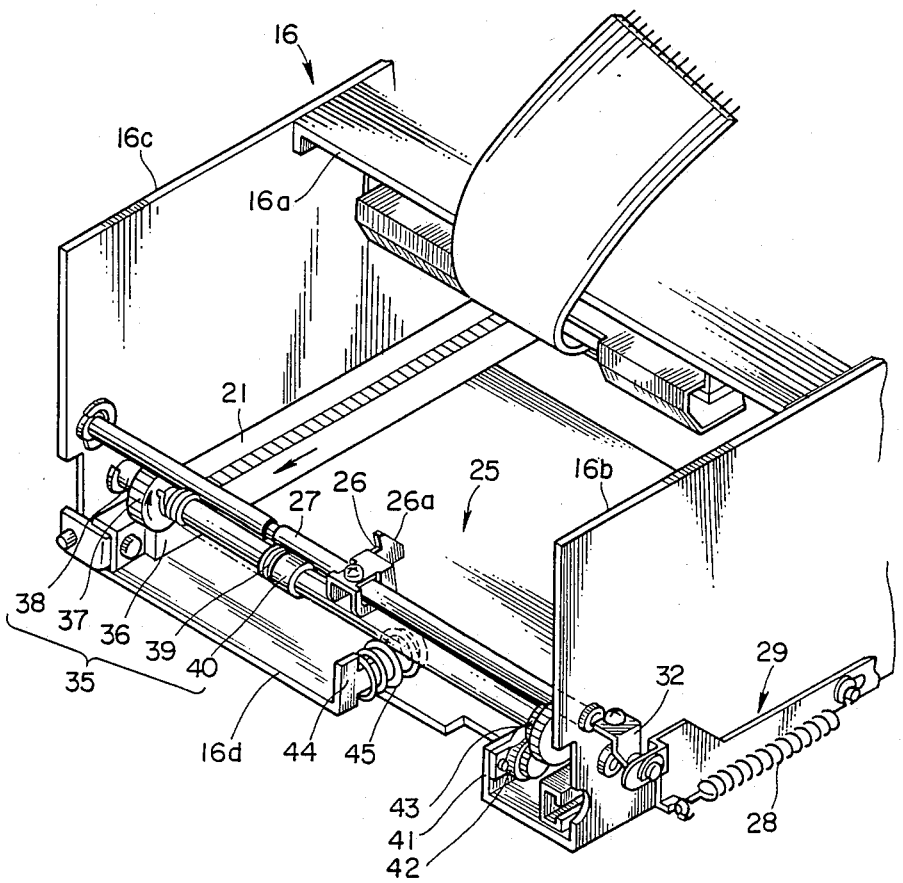
FIG. 2 is a partial perspective view of the printer as viewed from the back.

As seen from FIG. 2, the link lever 32 is associated with the lock release lever 29 which is manually operable for releasing the locking engagement between the stopper shaft 24 and the locking hook 16. The lock release lever 29 is formed with an elongated hole 30. A guide pin 31 extending laterally from the outer surface of the side wall 16b passes through the elongated hole 30 for guiding reciprocal movement of the lock release lever therealong. The lock release lever 29 has a manually operable grip 33 at the front end thereof. The biasing coil spring 28 engages to the guide pin 31 at one end and to a hook 34 laterally extended from the lock release lever 29 at the other end. Therefore, the lock release lever 29 is normally biased forward and thereby exerts the locking direction locking force to the rotary shaft 27 via the link lever 32. By depressing the manually operable grip rearwardly, the lock release lever 29 slides along the arrow 'a' of FIG. 1, guided by the guiding engagement between the elongated hole 30 and the guide pin 31 to rotate the rotary shaft 27 in the lock release direction.

A movable chassis drive mechanism 35 cooperates with the movable chassis. The movable chassis drive mechanism 35 also cooperates with the lock release lever 29 to drive the movable chassis to the extracted position when the lock release operation is performed through the lock release lever 29. The movable chassis drive mechanism 35 comprises racks 36 fixed onto the surfaces of vertical wall sections of the sliding rails 21, which surface is exposed toward the inner space of the movable chassis, and pinions 37 engageable with the rack teeth of the racks 36. The pinions 37 are rotatably supported by means of a pinion shaft 38 extending laterally at the rear end of the stationary chassis. A torsion spring 39 is wound around the pinion shaft 38. One end of the torsion spring 39 engages with a fixture 40 fixed to the pinion shaft. The other end of the torsion spring 39 engages with the pinion 37. The torsion spring 39 is so arranged as to accumulate spring force during the travel of the movable chassis 17 from the extruded position to the set position. This accumulated force serves as a driving force to rotate the pinions 37 to drive the movable shaft forward together with the rack 36 to the extracted position.

While the movable chassis 17 is locked at the set position, the torsion spring 39 maintains the accumulated spring force. Therefore, as soon as the locking engagement between the stopper shaft 24 and the locking hook 26 is released by manual operation of the lock release lever 29, the pinions 37 are driven by the accumulated spring force of the torsion spring to rotate. This rotational torque of the pinions 37 is converted into forward driving force by the rack-and-pinion engagement of the movable chassis drive mechanism.

In order to avoid the movable chassis drive mechanism driving the movable chassis at excessively high speed and to allow the movable chassis to be moderately driven to the extracted position, a brake mechanism is provided. The brake mechanism comprises a brake roller 42 supported by means of a vertical extension 41 vertically extended from the lower plate 16d of the stationary chassis. The brake roller 42 frictionally engages a pinion 43 fixed to the pinion shaft 38 for exerting frictional braking force. By this braking force, the rotational speed of the pinion shaft is reduced and thus the rotational speed of the pinions 37 is reduced to slow down the movement of the movable chassis from the set position to the extracted position.

On the other hand, a damper spring 45 is provided in order to absorb shock and exerts spring force to the movable chassis toward the front so as to assure and maintain locking engagement between the stopper shaft 24 and the locking hook 26. The damper spring 45 is supported by means of a vertically extending spring support strip 44 extending from the lower plate 16d of the stationary chassis 16.

Figure 4:
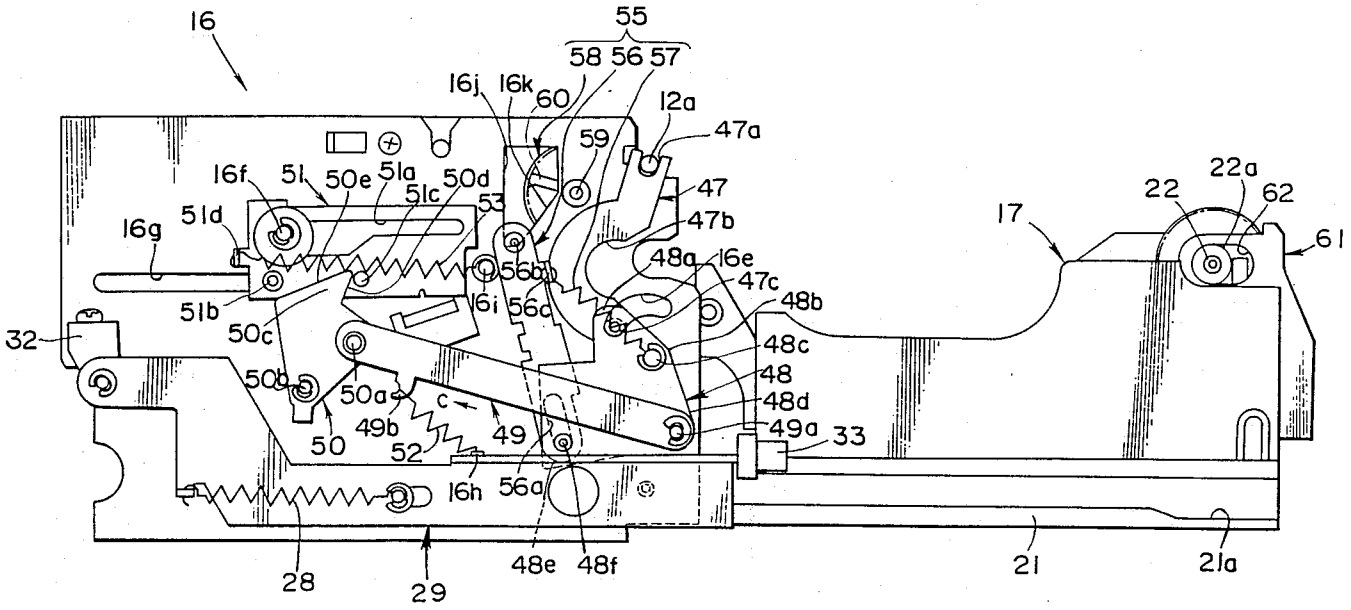
FIG. 4 is a side elevation of the printer of FIG. 1, in which a sub-chassis is drawn-out from a main chassis.
Figure 5:
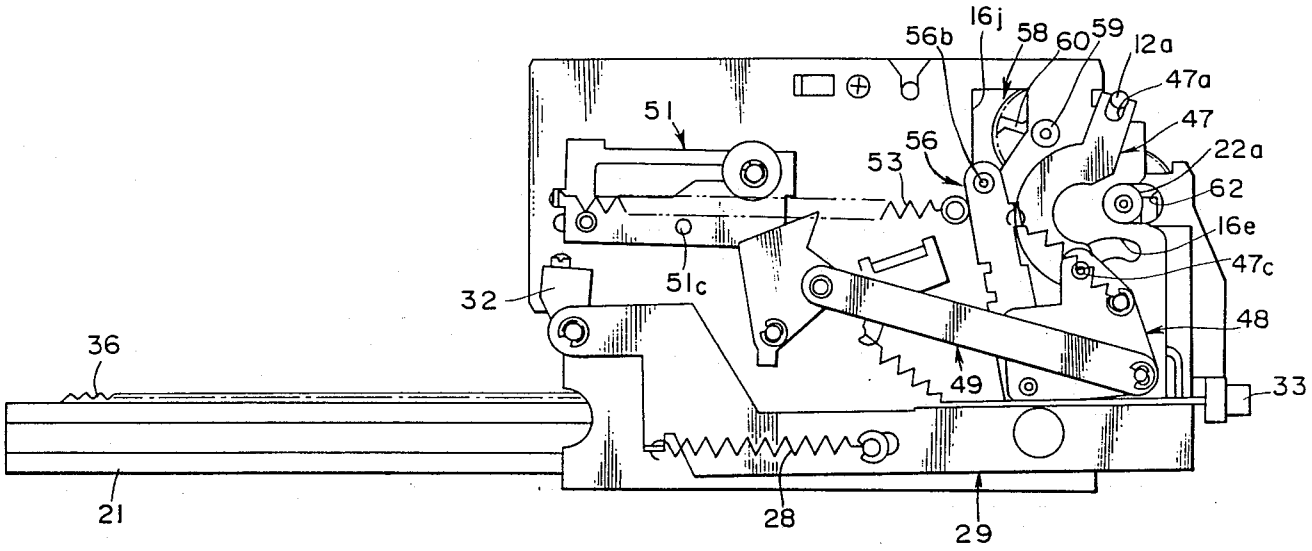
FIG. 5 is a side elevation similar to FIG. 4, but showing the condition in which the sub-chassis is set within the main chassis and a printer head is biased toward a platen.

The printer 11 is also provided with a head lifting mechanism 16. As shown in FIG 4, the head lifting mechanism 46 comprises a first link lever 47, a second link lever 48, a third link lever 49, a fourth link lever 50, a fifth link lever 51, a first return coil spring 52 and a second return coil spring 53. The first link lever 47 is formed with an essentially U-shaped cut out 47a at the upper end thereof. The cut out 47a receives a shaft 12a extending from the lateral end of the printer head 12. The other end of the first link lever 47 is pivoted for pivotal movement about a pivot shaft 48c. The pivotal movement of the first link lever 47 is guided by means of a pin-and-slot engagement. The pin-and-slot engagement is established by a pin 47c extending from the other end of the first link lever 47 and an arc shaped elongated opening 16e formed through the vertical side wall 16b of the stationary chassis. When the first link lever 47 is in a head down position, as shown in FIGS. 4 and 5, the pin 47c is located at the rear and lower end of the arc-shaped slot 16e to lower the printer head 12 to a head down position. On the other hand, as seen from FIG. 6, when the first link lever 47 is pivoted to a head up position, the pin 47c is located at the front and upper end of the arc-shaped slot 16e to lift up the printer head to a head up position. The first link lever 47 has a curved intermediate section 47b. The curvature of the curved intermediate section 47b conforms to the outer circumference of the bearing bushing 22a of the platen shaft 22 to receive the same.

The second link lever 48 is formed into a generally L-shaped configuration and is pivotable about the pivot shaft 48*c* at the bent corner section 48*b*. As will be seen from FIG. 5, the orientation of the pivot shaft 48*c* relative to the arc-shaped elongated opening 16*e* is such that the axis of the pivot shaft 48*c* resides at the center of the semi-circle of the arc-shaped elongated opening 16*e*. The upper end section 48*a* of the second link lever 48 is pivotably connected to the first link lever 47 via the pin 47*c*. The third link lever 49 is connected to the bent corner section 48*d* of the second link lever 48 via a connection pin 49*a* at the front end thereof. On the other hand, the other end of the third link lever 49 is connected to the fourth link lever 50 via a connecting pin 50*a* at its rear end. The fourth link lever 50 is pivotable about a pivot shaft 50*b* extending from the side wall 16*b* of the stationary chassis 16.

The fourth link lever 50 has a contact piece section 50*c* opposing a contact pin 51*c* projecting from the fifth link lever 51. The fifth link lever 51 is formed with a longitudinally extending elongated hole 51*a*. The fifth link lever 51*b* has a guide pin 51 extending from one surface at the opposite side to the surface from which the contact pin 51*c* projects. The guide pin 51*b* extends through a longitudinally extending guide slot 16*g* formed in the side wall 16*b* of the stationary chassis. With this engagement of the guide pin 51*b* and the guide slot 16*g*, the fifth link lever 51 may move in reciprocal fashion in the longitudinal direction. On the other hand, the elongated hole 51*a* of the fifth link lever 51 receives a guide pin 16*f* extending from the side wall 16*b* of the stationary chassis 16.

The third link lever 49 is biased in a counterclockwise direction in FIG. 5 by means of the first return spring 52 which is connected to a hook 49*b* extending from the lower edge of the third link lever 49. The other end of the first return spring 52 is connected to a spring hook 16*h* extending from the lock release lever 29. On the other hand, the second return spring 53 normally biases the fifth link lever 51 forward. One end of the second return spring 53 is connected to a spring hook 51*d* laterally extending from the rear vertical edge of the fifth link lever 51. The other end of the second return spring 53 is connected to a stationary pin 16*i* laterally extending from the side wall 16*b* of the stationary chassis 16.

The guide pin 51*b* of the fifth link lever 51 extends into the internal space of the stationary chassis 16 via the guide slot 16*g*. The inner end of the guide pin 15*b* is so oriented to contact with a contact piece 54 (seen in FIG. 1) of the rear end of the movable chassis 17 while the movable chassis travels from the extracted position to the set position. By contacting with the contact piece 54, the guide pin 51*b* with the fifth link lever 51 is pushed rearwardly according to rearward movement of the movable chassis 17. This rearward movement causes counterclockwise pivotal movement of the fourth link lever 50 about the pivot shaft 40*b* by a biasing force exerted on the contact piece 50*c* via the contact pin 51*c*. Accordingly, the third link lever 49 moves rearwardly against the biasing force of the first return spring 52. This causes pivotal movement of the second link lever 48 with the pin 47*c* to pivotally move the first link lever 47 to the head up position.

Therefore, as will be appreciated from the above, the printer head 13 is driven to the head up position while the movable chassis 17 is moved from the extracted position to the set position. At this head up position, the pin 47*c* is located at the upper end of the arc-shaped elongated opening 16*e* to lock at the head up position. In this head up operation, the printer head 12 rises to allow the platen 13 to pass into the inside of the stationary chassis 16 without interfering with the motion of the movable chassis 17.

A head down mechanism 55 is provided in cooperation with the head up mechanism set forth above. The head down mechanism 55 includes a link lever 56, a bias spring 57 and a kick gear 58. The link lever 56 is formed with an elongated hole 56*a* adjacent the lower portion thereof. The elongated hole 56*a* receives a connection pin 48*f* projecting from the rear end corner 48*e* of the second link lever 48. The upper end portion of the link lever 56 carries a connecting pin 56*b* which is inserted into a cut-out 16*j* formed through the side wall 16*b* of the stationary chassis 16. The link lever 56 is constantly biased clockwise by means of the bias spring 57 which is connected to a spring strip 56*c* at one end and to the pivot shaft 48*c*. The connecting pin 56*b* is oriented to be placed at the lower end of the cut-out at the head down position of the printer head 12. On the other hand, when the printer head 12 is shifted to the head up position, the pin 48*f* of the second link lever pushes the link lever 56 upwardly. By this, the connecting pin 56*b* of the link lever 56 moves upwardly along the inclined edge 16*k* of the cut-out 16*j* to reach the upper end thereof.

The kick gear 58 is rotatably supported by a gear shaft 59 extending from the side wall 16 adjacent the cut-out 16*j*. The kick gear 58 has a plane surface, from which and essentially X-shaped projection 60 projects. The kick gear 58 is rotatable in the counterclockwise direction at the head up position. During counterclockwise rotation, the projection 60 depresses the link lever 56 downwardly to pivot the second link lever 48 in counterclockwise direction to shift the printer head to the head down position.

Both ends of the platen shaft 22 of the platen 13 ae inserted into a longitudinally extending elongated hole 62 of a platen guide 61 with a bearing bushing. As shown in FIG. 1, the preferred embodiment of the printer includes a platen retainer mechanism 65. The platen retainer mechanism 65 comprises an essentially V-shaped lever 63 and a coil spring 64. The coil spring 64 is connected to a lower side leg of the V-shaped lever at one end and connected to the side wall 17*c* of the movable chassis 17 so as to bias the V-shaped lever in counterclockwise direction in the FIG. 1. The upper side leg of the V-shaped lever 63 is normally in contact with the bearing bushing 22*a* of the platen shaft 22. Therefore, the upper side leg of the V-shaped lever 63 resiliently biases the bearing bushing 22*a* toward the rear end of the elongated opening 62. Since the V-shaped lever 63 is resiliently biased, it moves the platen shaft 22 with the bearing bushing 22*a* along the elongated opening 62. This assures accurate positioning of the platen 13 even when an error exists in the placement of the bearing bushing in the elongated opening 62 of the movable chassis.

As will be seen from FIG. 1, the slide rail 21 of the movable chassis 17 is formed with a stepped down section 21*a*. This allows the movable chassis 17 to be slightly lifted up when setting the platen onto the movable chassis by engaging the bearing bushings 22*a* to the elongated opening 62. This compensates for positional errors in the vertical direction between the printer head 12 and the platen 13.

Accordingly, the lower peripheral edge of the U-shaped positioning cut-out 23 is located slightly higher than the lower peripheral edge of the elongated opening 62. The height difference between the lower peripheral edges of the cut-out 23 and the elongated opening 62 substantially corresponds to the step-down dimension of the aforementioned stepped down section.

A gear 66 is secured to the platen shaft 22 for rotation therewith. The gear 66 meshes with the kick gear 58 in such a manner that the kick gear is driven by the gear 66 to automatically shift the printer head to the head down position when the platen 13 with the platen shaft 22 is rotated in the paper feed direction. The platen is further associated with a platen drive mechanism 67 which comprises a drive motor 68, reduction gears 69, 70 and 71 and a drive gear 72. The drive gear 72 is fixedly secured to the platen shaft 22 in side-by-side relationship with the gear 66. This drive mechanism is normally operable to drive the platen to feed the paper P in a predetermined amount in line feed operation. In addition, the driving torque transmitted from the reduction gear 71 to the drive gear serves to bias the platen 13 with the bearing bushing **22*a* of the platen shaft 22 rearwardly for establishing engagement between the drive gear and kick gear for head-up operation during line feed operation. In the operation of the preferred embodiment of the printer set forth above, the manually operable grip 33 is operated when the rolled paper P should be replaced. In practice, the manually operable grip of the lock release lever 29 is depressed rearwardly. Accordingly, the lock release lever 29 is shifted rearwardly against the force of the coil spring 28. By this rearward movement of the lock release lever 29, the link lever 32 is pivoted in the clockwise direction in FIG. 2, to release locking engagement between the stopper shaft 24 of the movable chassis and the locking hook 26. Therefore, the movable chassis 17 becomes unlocked. This allows clockwise rotation of the pinion with the pinion shaft by the accumulated spring force. The pinion 37 thus drives the rack 36 forward and whereby drives the movable chassis forward. Therefore, the movable chassis 17 can be driven forward to the extracted position for exposing the rolled paper receiving space 14, as shown in FIG. 4**.

After replacing the rolled paper in the space 14, the movable chassis 17 is manually pushed into the stationary chassis to be placed at the set position, as shown in FIG. 5. During rearward travel of the movable chassis 17, the pinion 37 engaging with the rack 36 is driven in the counterclockwise direction. Accordingly, the pinion shaft 38 rotates to increase stress on the torsion spring 39 to accumulate spring force.

On the other hand, as set forth above, while the movable chassis moves from the extracted position to the set position, the inner end of the guide pin **51*b* contacts with the contact piece 54 of the rear end of the movable chassis 17. By contacting with the contact piece 54, the guide pin 51*b* with the fifth link lever 51 is pushed rearwardly according to rearward movement of the movable chassis 17. This rearward movement causes counterclockwise pivotal movement of the fourth link lever 50 about the pivot shaft 40*b* by a biasing force exerted on the contact piece 50*c* via the contact pin 51*c*. Accordingly, the third link lever 49 moves rearwardly against the biasing force of the first return spring 52. This causes pivotal movement of the second link lever 48 with the pin 47*c* to pivotally move the first link lever 47 to the head up position. Therefore, the printer head 13 is driven to the head up position while the movable chassis 17 is moved from the extracted position to the set position. At this head up position, the pin 47*c* is located at the upper end of the arc-shaped elongated opening 16*e* to lock at the head up position. In this head up operation, the printer head 12 rise to allow the platen 13 to pass into the inside of the stationary chassis 16 without interferring with the motion of the movable chassis 17**.

At the end of the rearward travel of the movable chassis 17, the stopper shaft 24 comes into contact with the tapered edge **26*a* of the locking hook 26. By exerting the rearward depression force, the locking hook 26 with the rotary shaft 27 is caused to rotate in the clockwise direction to allow the stopper shaft 24 pass thereover. After passing over the stopper shaft 24, the locking hook with the rotary shaft 27 again rotates, in the counterclockwise direction, to establishing locking engagement with the stopper shaft 24. Therefore, the movable chassis 17** can be set at the position.

Figure 6:
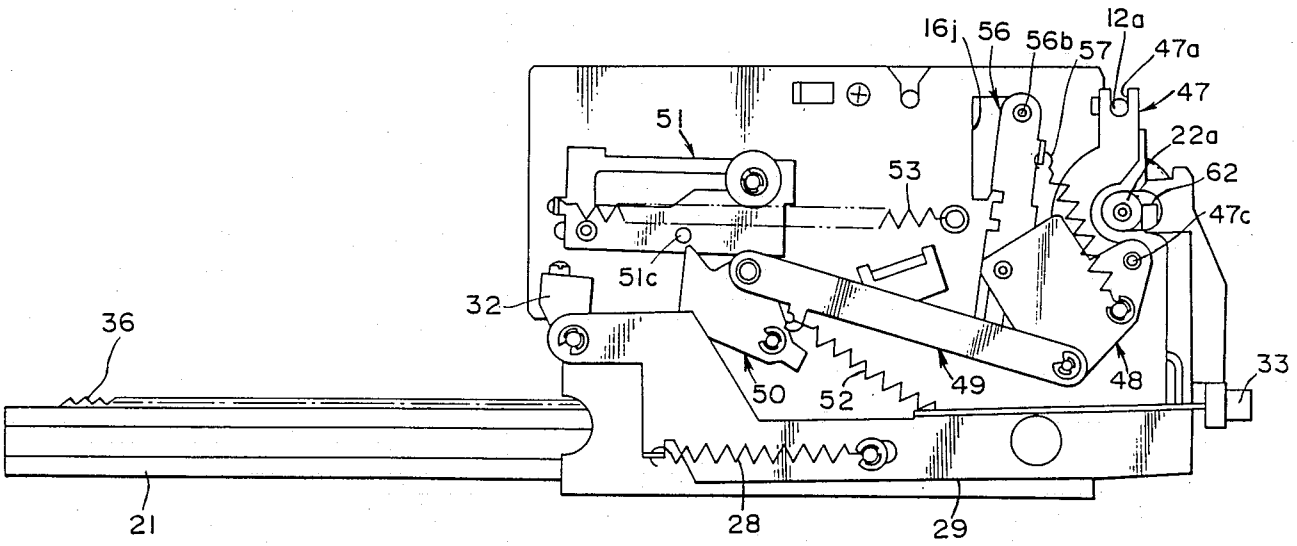
FIG. 6 is a side elevation similar to FIG. 5, but showing a condition in which the printer head is placed away from the platen.
Figure 7:
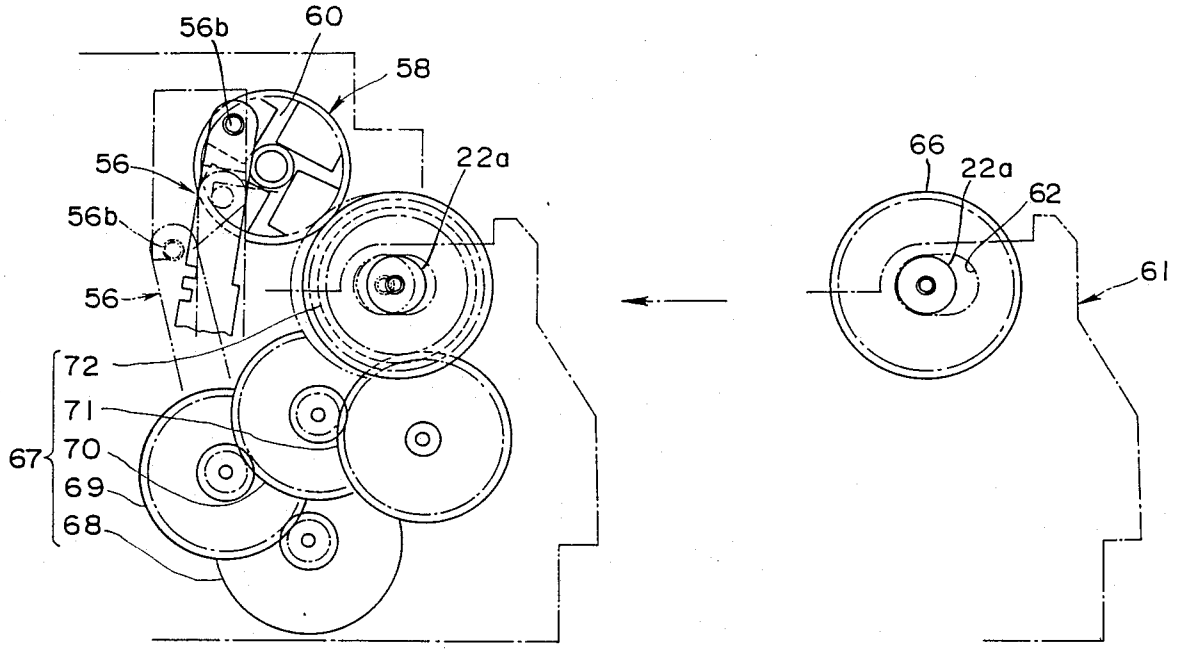
FIG. 7 is a front elevation of a plate drive mechanism in the preferred embodiment of the printer of FIG. 1.

At this position, the printer head 12 is held at the head-up position. When the platen 13 is rotated in a paper feeding direction, the kick gear 58 has a plane surface, from which the essentially X-shaped projection projects. The kick gear 58 is rotatable in the counterclockwise direction at the head up position. During counterclockwise rotation, the projection 60 depresses the link lever 56 to pivot the second link lever 48 in the counterclockwise direction to shift the printer head to the head down position, as shown in FIG. 6.

As set forth above, the printer according to the invention allows replacement of the rolled paper easily without requiring complicated manual operations. The printer also becomes satisfactorily compact. In addition, since the printer head can be held at the head up position until the paper feed operation is completed, it eliminates the possibility of damaging of the printer head during transportation. As well, by maintaining the platen away from the printer head, wearing and deformation of the platen can be successfully prevented to expand the life of the platen. Furthermore, it provide the convenience of using a mechanical kinematic action for shifting the movable chassis from the set position to the extracted position without requiring any electric power.

As will be appreciated, the present invention fulfills all the objects and advantages sought therefor.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A printer comprising:

a stationary chassis;

a movable chassis slidably mounted on said stationary chassis for movement between an inoperative position and an operative position;

a platen mounted at a front portion of said movable chassis;

a printing head mounted at a front portion of said stationary chassis so as to oppose said platen when said movable chassis is slid into the operative position;

printing head lifting links mounted on said stationary chassis for lifting said printing head away from said platen when said movable chassis is pushed into said operative position; and lifting links releasing means coupled to said platen and said printing head lifting links for releasing said printing head in response to rotation of said platen so that said printing head is pressed against said platen.

2. A printer according to claim 1, wherein a printing medium-storing portion is defined in said movable chassis.

3. A printer according to claim 1, wherein said printing head is a thermal head for use with a heat sensitive recording paper.

4. A printer according to claim 1, wherein said platen and said printing medium storing portion are horizontally arranged together and said printing medium storing portion is arranged on said movable chassis rearward of said platen.

5. A printer according to claim 1, wherein said printing medium storing portion has a fixing portion for rotatably fixing a roll of paper, wherein said fixing portion is arranged at each side of said printing medium storing portion.

6. A printer according to claim 1, which further comprises a sliding structure for sliding movement of said movable chassis relative to said stationary chassis, said sliding structure including a pair of rails having a C-shape in cross section, and roller means positioned within each said rail.

7. A printer according to claim 6, wherein said rails are mounted on said movable chassis, and said roller means is mounted on said stationary chassis.

8. A printer according to claim 1, further comprising means for locking said movable chassis in said operative position.

9. A printer according to claim 8, wherein said locking means includes a shaft on said movable chassis and a hook on said stationary chassis for engaging said shaft.

10. A printer according to claim 8, further comprising means for releasing said locking means.

11. A printer according to claim 10, further comprising means for driving said movable chassis from said operative position to said inoperative position when said locking means are released.

12. A printer according to claim 11, wherein said driving means comprises a racks attached to said rails, pinions engaging said racks, a supporting shaft attaching said pinions to said stationary chassis, and a spring biasing one of said pinions into rotation, said spring being secured to said biased pinion and said supporting shaft.

13. A printer, comprising:

a stationary chassis;

a movable chassis slidably mounted on said stationary chassis;

a platen and a printing medium storing portion defined within said movable chassis, said platen defining a longitudinal axis and having a shaft defining opposite ends, said movable chassis being mounted for sliding along an axis that is substantially normal to the longitudinal axis of said platen;

a printing head mounted on said stationary chassis;

a platen positioning means mounted on each side of said stationary chassis for fixing the ends of said platen shaft when said movable chassis is inserted into said stationary chassis; and means for mounting the platen shaft on said movable chassis so as to permit movement of the platen shaft in a direction parallel to the movement of said movable chassis.

14. A printer according to claim 13, wherein the platen shaft mounting means comprises V-shaped pivotable means for biasing said platen shaft in the direction of said movable chassis insertion.

15. A printer according to claim 13, wherein each end of said platen shaft has a bearing bushing.

16. A printer according to claim 13, wherein said movable chassis is movable between an inoperative position and an operative position, and the position of said platen positioning means is at a height slightly higher than the position of said platen shaft when said movable chassis is in the inoperative position, and said movable chassis is liftable by a distance approximately equal to the difference in heights of the platen positioning means and the platen shaft.

17. A printer according to claim 16, further comprising a sliding structure including rails and roller means engaging said rails, each said rail having a C-shape in cross section and a forward portion in which the distance between the ends of the C is wider than in the rest of the rail, said wider distance allowing the movable chassis to be lifted.

18. A printer comprising:

a stationary chassis;

a movable chassis slidably mounted on said stationary chassis;

a platen rotatably mounted on said movable chassis;

a printing head mounted on said stationary chassis and biased towards an operative position of said platen;

lifting links for moving said printing head against the bias from an operative position opposing the operative position of the platen to an inoperative position spaced from the operative position of the platen; and means for releasing said lifting links to move said printing head from its inoperative position to its operative position, said releasing means including a driving structure actuated by ordinary rotation of said platen.

19. A printer according to claim 18, wherein said printing head lifting links ae composed of plural links operated by the sliding of said movable chassis relative to said stationary chassis.

20. A printer according to claim 19, wherein said lifting links comprise a first link connected to said printing head, a second link connected to said first link, a third link connected to said second link, a first spring connected to said third link for biasing said third link, a fourth link connected to said third link and pivotally connected to said stationary chassis, a fifth link mounted on said stationary chassis, said fifth link being movable by the movement of said movable chassis relative to said stationary chassis, and a second spring connected to said fifth link to bias said fifth link against its movement caused by the movement of the movable chassis.

21. A printer according to claim 20, further comprising a pin on said fifth link and means on said movable chassis for contacting said pin, whereby said lifting links and said printing head are moved in response to the movement of said movable chassis relative to said stationary chassis.

22. A printer according to claim 20, wherein said means for releasing said lifting links comprises a link bar and a third spring connected to said link bar.

23. A printer according to claim 22, wherein said link bar is connected to said second link.

24. A printer according to claim 23, wherein said link bar has a pin engaged by said driving structure.

25. A printer according to claim 24, wherein movement of said driving structure moves said pin engaged by said driving structure a distance sufficient to release said printing head lifting links.

26. A printer according to claim 18, wherein said driving structure comprises a kick gear and a driving gear for the kick gear.

27. A printer according to claim 26, wherein said kick gear is connected to said platen for rotation therewith.

28. A printer according to claim 26, wherein said kick gear has an X-shaped projection.

* * * * *